US010466003B2

(12) United States Patent
Thompson et al.

(10) Patent No.: US 10,466,003 B2
(45) Date of Patent: Nov. 5, 2019

(54) HEAT-DEFLECTING SUPPRESSOR COVER FOR FIREARM

(71) Applicant: Jelis Incorporated, North Bend, WA (US)

(72) Inventors: Jesse Brian Thompson, North Bend, WA (US); Tarrol Walker Peterson, Ellensburg, WA (US)

(73) Assignee: Jelis Incorporated, North Bend, WA (US)

( * ) Notice: Subject to any disclaimer, the term of this patent is extended or adjusted under 35 U.S.C. 154(b) by 0 days.

(21) Appl. No.: 15/948,872

(22) Filed: Apr. 9, 2018

(65) Prior Publication Data

US 2018/0292159 A1 Oct. 11, 2018

Related U.S. Application Data

(60) Provisional application No. 62/483,780, filed on Apr. 10, 2017.

(51) Int. Cl.
*F41A 21/24* (2006.01)
*F41A 21/30* (2006.01)

(52) U.S. Cl.
CPC ..... *F41A 21/24* (2013.01); *F41A 21/30* (2013.01)

(58) Field of Classification Search
CPC ..... F41A 21/24; F41A 21/30; F41A 21/44; F41A 21/28
USPC ..... 89/14.1, 16; 42/76.01
See application file for complete search history.

(56) References Cited

U.S. PATENT DOCUMENTS

| | | | | |
|---|---|---|---|---|
| 6,508,159 | B1 * | 1/2003 | Muirhead | F41A 21/24 42/76.01 |
| 8,967,325 | B1 * | 3/2015 | Cronhelm | F41A 13/00 181/223 |
| 9,658,010 | B1 * | 5/2017 | Oglesby | F41A 13/12 |
| 10,126,084 | B1 * | 11/2018 | Oglesby | F41A 21/30 |
| 2012/0167435 | A1 * | 7/2012 | Poling | F41A 13/12 42/90 |
| 2013/0061503 | A1 * | 3/2013 | W | F41A 21/44 42/76.01 |
| 2014/0190345 | A1 * | 7/2014 | Daniel | F41A 21/325 89/193 |
| 2015/0241159 | A1 * | 8/2015 | Michal | F41A 21/30 89/14.4 |
| 2015/0362276 | A1 * | 12/2015 | Fischer | F41G 11/003 89/14.4 |
| 2016/0010935 | A1 * | 1/2016 | Clarke | F41A 21/34 89/14.4 |
| 2017/0115084 | A1 * | 4/2017 | Hailey | F41A 21/28 |

(Continued)

*Primary Examiner* — John Cooper
(74) *Attorney, Agent, or Firm* — Lowe Graham Jones PLLC

(57) ABSTRACT

Embodiments are directed to a suppressor cover for firearm suppressors. The suppressor cover may include a cover body that is sized and dimensioned to house a suppressor of a firearm having one or more sights. The body may have a longitudinal axis, a lateral axis, an upper portion, and a lower portion. The body may be coupleable to the firearm below the one or more sights. The body may have one or more intake ports that are disposed in the lower portion of the body. The body may have one or more exhaust ports that are disposed in the upper portion of the body and that are laterally spaced apart from the one or more sights when the body is coupled to the firearm.

20 Claims, 9 Drawing Sheets

(56) References Cited

U.S. PATENT DOCUMENTS

| | | | | |
|---|---|---|---|---|
| 2017/0153080 | A1* | 6/2017 | Roberts | F41A 21/44 |
| 2017/0299291 | A1* | 10/2017 | Spector | F41G 11/003 |
| 2018/0306546 | A1* | 10/2018 | Roberts | F41A 21/44 |

* cited by examiner

HEAT-DEFLECTING SUPPRESSOR COVER FOR FIREARM

CROSS-REFERENCE TO RELATED APPLICATIONS

This application claims the benefit of U.S. Provisional Application No. 62/483,780, entitled "Heat-Deflecting Suppressor Cover for Firearm," filed 10 Apr. 2017, which is incorporated herein by reference in its entirety.

FIELD OF THE INVENTION

This application relates to covers for firearm suppressors and, more particularly, yet not exclusively, covers that guide heated air away from shooters' lines of sight to targets.

BACKGROUND OF THE INVENTION

When firearms having suppressors (for example, sound suppressors, flash or signature suppressors, or others) are rapidly fired, the burning propellant gases typically heat the suppressors to high temperatures. When heated to high temperatures, the suppressors often sufficiently heat the air around the suppressors to generate heat haze that emanates upward along the upper surfaces of the suppressors. Because firearm sights (for example, iron sights, optical sights, or others) are typically laterally aligned with and vertically offset above suppressors, the heat haze often distorts shooters' views of targets, thereby decreasing shooting accuracy.

Typical suppressor covers or wraps surround the suppressors to insulate the air around the suppressors from the high temperatures of the suppressors or to contain the heated air around the suppressors. When heated to sufficiently high temperatures for sufficient durations, however, suppressors can incur damage (for example, warping, cracking, or others). Accordingly, because typical suppressor covers or wraps slow the rates of heat flow from the suppressors, typical suppressor covers or wraps increase the likelihood that the suppressors incur damage when rapidly firing for a given duration. Thus, it is with regard to these considerations and others that the present invention has been made.

BRIEF DESCRIPTION OF THE DRAWINGS

Non-limiting and non-exhaustive embodiments of the present innovations are described with reference to the following drawings. In the drawings, like reference numerals refer to like parts throughout the various figures unless otherwise specified. For a better understanding of the described innovations, reference will be made to the following Detailed Description of the Preferred Embodiment, which is to be read in association with the accompanying drawings, wherein.

SUMMARY OF THE INVENTION

Figure 1:
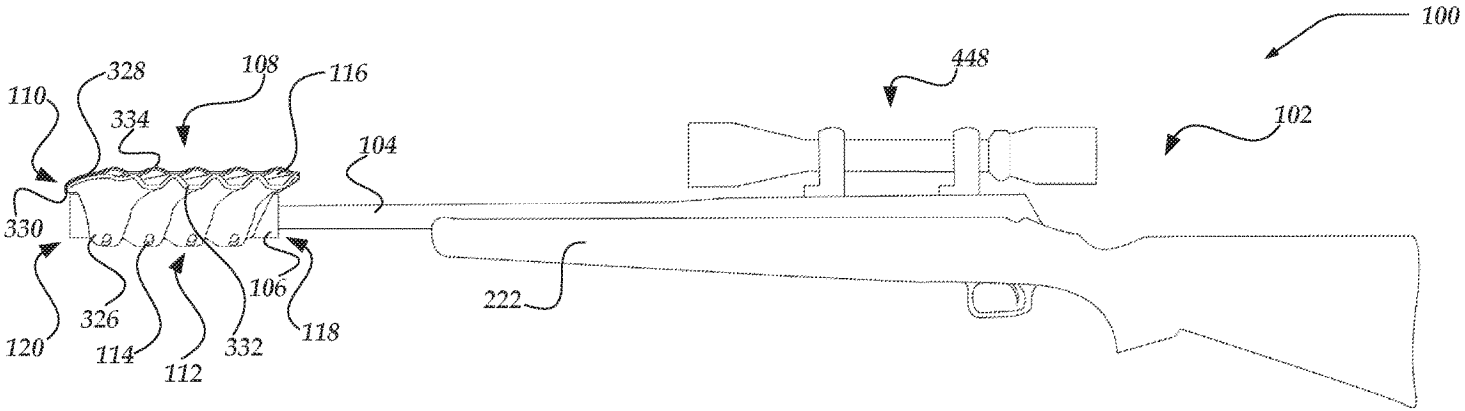
FIG. 1 shows a side-elevational view of an example firearm system, including an example firearm with an example suppressor and including an example suppressor cover that houses the suppressor and that extends from a proximal end portion of the suppressor to a distal end portion of the suppressor.

The following briefly describes example embodiments of the invention in order to provide a basic understanding of some aspects of the invention. This brief description is not intended as an extensive overview. It is not intended to identify key or critical elements or to delineate or otherwise narrow the scope. Its purpose is merely to present some concepts in a simplified form as a prelude to the more detailed description that is presented later.

Briefly stated, various embodiments are directed to a suppressor cover for firearm suppressors. In one or more of the various embodiments, the suppressor cover may include a cover body that is sized and dimensioned to house a suppressor of a firearm having one or more sights. In some embodiments, the body may have a longitudinal axis and a lateral axis. In some embodiments, the body may have an upper portion and a lower portion. In some embodiments, the body may be coupleable to the firearm below the one or more sights. In some embodiments, the body may have one or more intake ports that are disposed in the lower portion of the body. In some embodiments, the body may have one or more exhaust ports that are disposed in the upper portion of the body and that are laterally spaced apart from the one or more sights when the body is coupled to the firearm.

Also briefly stated, various embodiments are directed to a method of reducing heat haze in a shooter's line of sight. In one or more of the various embodiments, the method may include coupling a suppressor cover to a firearm having a suppressor and one or more sights. In some of the various embodiments, the suppressor cover may house the suppressor and may be laterally aligned with the one or more sights. In some embodiments, the suppressor cover may have a cover body that is sized and dimensioned to house the suppressor. In some embodiments, the body may have a longitudinal axis and a lateral axis. In some embodiments, the body may have an upper portion and lower portion. In some embodiments, the body may have one or more intake ports that are disposed in the lower portion of the body. In some embodiments, the body may have one or more exhaust ports that are disposed in the upper portion of the body and that are laterally spaced apart from the one or more sights. In some embodiments, the method may include firing the firearm at a sufficient rate over a sufficient duration to heat the suppressor and to generate heat haze that emanates from the suppressor. In some embodiments, the method may include looking along a line of sight that extends from the one or more sights and over the suppressor cover to a target, with heated air venting out of the one or more exhaust ports.

In one or more of the various embodiments, the upper portion of the body may have an outwardly extending flange, the flange having one or more downward bends that at least partially define one or more of the one or more exhaust ports.

In one or more of the various embodiments, the upper portion of the body may have left and right laterally outer edges and one or more upward bends in one or more of the left and right laterally outer edges. In some of the various embodiments, the one or more upward bends may at least partially define one or more of the one or more exhaust ports.

In one or more of the various embodiments, the upper portion of the body may have left and right laterally outer edges and one or more upward bends in one or more of the left and right laterally outer edges. In some of the various embodiments, the one or more upward bends may at least partially define one or more of the one or more exhaust ports and may extend inward from the one or more of the left and right laterally outer edges.

In one or more of the various embodiments, the upper portion of the body may have left and right laterally outer edges and one or more upward bends in one or more of the left and right laterally outer edges. In some of the various embodiments, the one or more upward bends may at least partially define one or more of the one or more exhaust ports and may extend inward from the one or more of the left and right laterally outer edges in a direction that is transverse to the longitudinal and lateral axes of the body.

In one or more of the various embodiments, the body may have a proximal end portion and a distal end portion. In some of the various embodiments, the longitudinal axis of the body may be laterally central to the body and may extend from the proximal end portion to the distal end portion. In some embodiments, the body may have a top surface that has left and right laterally outer edges that extend from the proximal end portion to the distal end portion. In some embodiments, the top surface of the body may be lower along the longitudinal axis of the body than at the left and right laterally outer edges.

In one or more of the various embodiments, the body may have one or more ribs that project inward and that extend from the lower portion of the body to the upper portion of the body.

In one or more of the various embodiments, the body may have two or more ribs that project inward and that extend from the lower portion of the body to the upper portion of the body to define one or more airflow channels between the two or more ribs. In some of the various embodiments, each of the one or more airflow channels may fluidly couple one or more of the one or more intake ports to one or more of the one or more exhaust ports.

In one or more of the various embodiments, the body may have two or more ribs that project inward and that extend from the lower portion of the body to the upper portion of the body to define one or more airflow channels between the two or more ribs. In some of the various embodiments, each of the one or more airflow channels may be more proximal in the upper portion of the body than in the lower portion of the body.

In one or more of the various embodiments, the one or more sights have left and right laterally outer edges and a lateral length that extends from the left laterally outer edge to the right laterally outer edge. In some of the various embodiments, the one or more exhaust ports may be laterally spaced apart from the lateral outer edges of the one or more sights by a distance that is at least 10% of the lateral length of the one or more sights.

In one or more of the various embodiments, the body may include a base having an upper portion and a lower portion with the one or more intake ports disposed in the lower portion of the base. In some of the various embodiments, the body may include a top coupled to the upper portion of the base. In some embodiments, the body may include an intermediate cap disposed between the base and the top.

In one or more of the various embodiments, the suppressor cover may include one or more insulation layers coupled to the upper portion of the body.

In one or more of the various embodiments, the suppressor cover may include one or more insulation layers coupled to the upper portion of the body. In some of the various embodiments, the upper portion of the body may have a recess that is sized and dimensioned to receive one or more of the one or more insulation layers.

In one or more of the various embodiments, the body may have a proximal end portion and a distal end portion. In some of the various embodiments, each of the proximal and distal end portions may have a hole that is sized and dimensioned to receive the suppressor.

In one or more of the various embodiments, when the body houses the suppressor, the one or more intake ports may be disposed below the suppressor. In some of the various embodiments, when the body houses the suppressor, the one or more exhaust ports may be disposed above the suppressor.

DETAILED DESCRIPTION OF THE PREFERRED EMBODIMENT

The various embodiments now will be described more fully hereinafter with reference to the accompanying drawings, which form a part hereof and show, by way of illustration, specific example embodiments by which the invention may be practiced. The embodiments may, however, be embodied in many different forms and should not be construed as limited to the embodiments set forth herein; rather, these embodiments are provided so that this disclosure will be thorough and complete and will fully convey the scope of the embodiments to those skilled in the art. Among other things, the various embodiments may be methods, systems, or devices. The following detailed description is, therefore, not to be taken in a limiting sense.

Throughout the specification and claims, the following terms take the meanings explicitly associated herein, unless the context clearly dictates otherwise. The phrase "in one embodiment" as used herein does not necessarily refer to the same embodiment, though it may. Furthermore, the phrase "in another embodiment" as used herein does not necessarily refer to a different embodiment, although it may. Thus, as described below, various embodiments may be readily combined, without departing from the scope or spirit of the invention.

In addition, as used herein, the term "or" is an inclusive "or" operator and is equivalent to the term "and/or," unless the context clearly dictates otherwise. The term "based on" is not exclusive and allows for being based on additional factors not described, unless the context clearly dictates otherwise. In addition, the meaning of "a," "an," and "the" include plural references. Also, plural references are intended to also disclose the singular, unless the context clearly dictates otherwise. The meaning of "in" includes "in" and "on." Also, the use of "when" and "responsive to" do not imply that associated resultant actions are required to occur immediately or within a particular time period. Instead, they are used herein to indicate actions that may occur or be performed in response to one or more conditions being met, unless the context clearly dictates otherwise.

As used herein, the term "shell" refers to external housing. For example, in many sound suppressors, the suppressor shell (the shell of the suppressor) is a metal cylinder that houses internal baffles. In use, the shell is normally uncovered when the suppressor is coupled to the firearm.

FIG. 1 shows a side view of example firearm system 100. In one or more of the various embodiments, system 100 may include example firearm 102 having barrel 104 and suppressor 106 disposed at a distal end portion of barrel 104. In some of the various embodiments, system 100 may also include example suppressor cover 108. In some embodiments, suppressor cover 108 may house suppressor 106. In some embodiments, suppressor cover 108 may include cover body 110 that has one or more segments 112. In some embodiments, one or more segments 112 may have one or more intake holes, ports, or vents 114 or one or more exhaust holes, ports, or vents 116. In some embodiments, cover body 110 may have a longitudinal length that extends from proximal end portion 118 of suppressor 106 to distal end portion 120 of suppressor 106. In some embodiments, suppressor cover 108 may be coupled to firearm 102 by coupling directly to suppressor 106, which may be integrally, fixedly, or separably coupled to barrel 104 of firearm 102. In some embodiments, suppressor 106 and suppressor cover 108 may be integrated.

Figure 2:
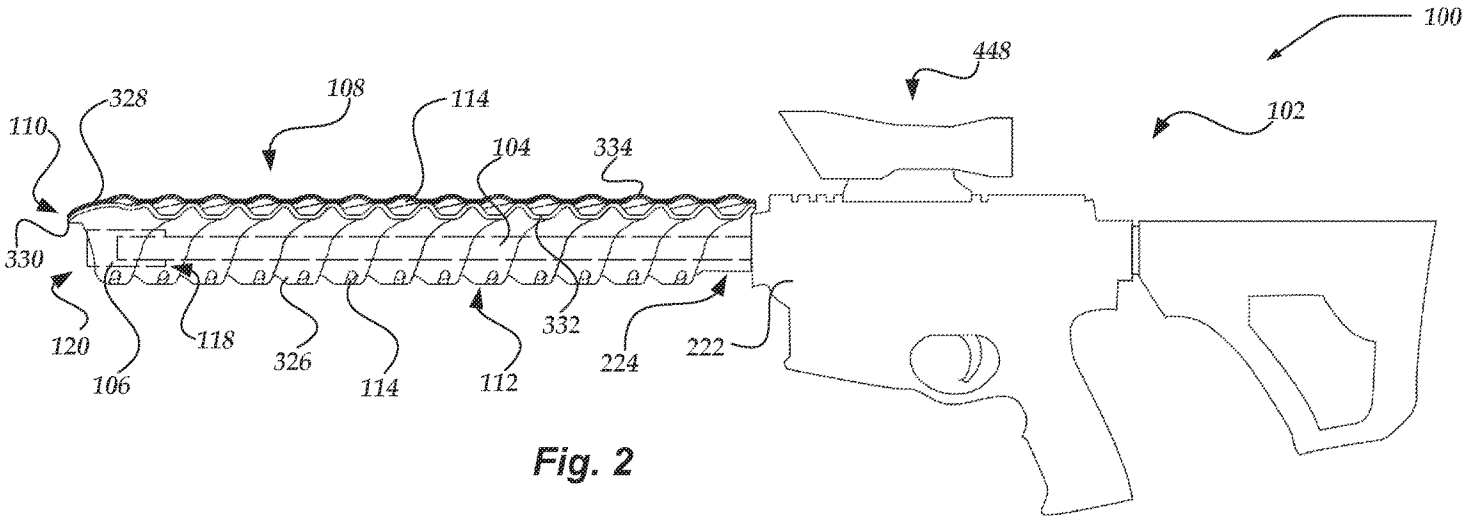
FIG. 2 illustrates a side-elevational view of an example firearm system with the suppressor cover extending from a distal end portion of a receiver of an example firearm to a distal end portion of an example suppressor.

FIG. 2 illustrates a side view of firearm system 100, with another style for firearm 102 and another style for suppressor 106. In one or more of the various embodiments, cover body 110 may house suppressor 106 and one or more portions of barrel 104 that are proximal to proximal end portion 118 of suppressor 106. In some of the various embodiments, the longitudinal length of cover body 110 may extend from a distal end portion of receiver 222 of firearm 102 to distal end portion 120 of suppressor 106. In some embodiments, the longitudinal length of cover body 110 may be increased or decreased by increasing or decreasing the quantity of segments 112, the longitudinal length of one or more segments 112, or others.

In one or more of the various embodiments, cover body 110 may include interface segment 224 disposed at the proximal-most segment position of cover body 110. In some of the various embodiments, interface segment 224 may have a proximal face that is sized and dimensioned to correspond to the shape and dimensions of the distal face of receiver 222, thereby facilitating covering an entirety of each portion of barrel 104 that is distal to receiver 222. In some embodiments, interface segment 224 may be devoid of intake holes, ports, or vents 114 or exhaust holes, ports, or vents 116. In some embodiments, an interior space of interface segment 224 may fluidly couple to one or more other segments 112, thereby facilitating guiding heated air away from the portion of barrel 104 that is housed by interface segment 224.

In one or more of the various embodiments, suppressor cover 108 may separably or fixedly couple to one or more of barrel 104, suppressor 106, or receiver 222. In some of the various embodiments, one or more portions of body 110 may be fixedly coupled to one or more of barrel 104, suppressor 106, or receiver 222 with adhesive, solder, brazing, welding, or others. In some embodiments, one or more portions of body 110 may separably couple to one or more of barrel 104, suppressor 106, or receiver 222 with threads, fasteners (for example, bolts, clips, clamps, or others), Snap-fit, interference fit, or others.

Figure 3:
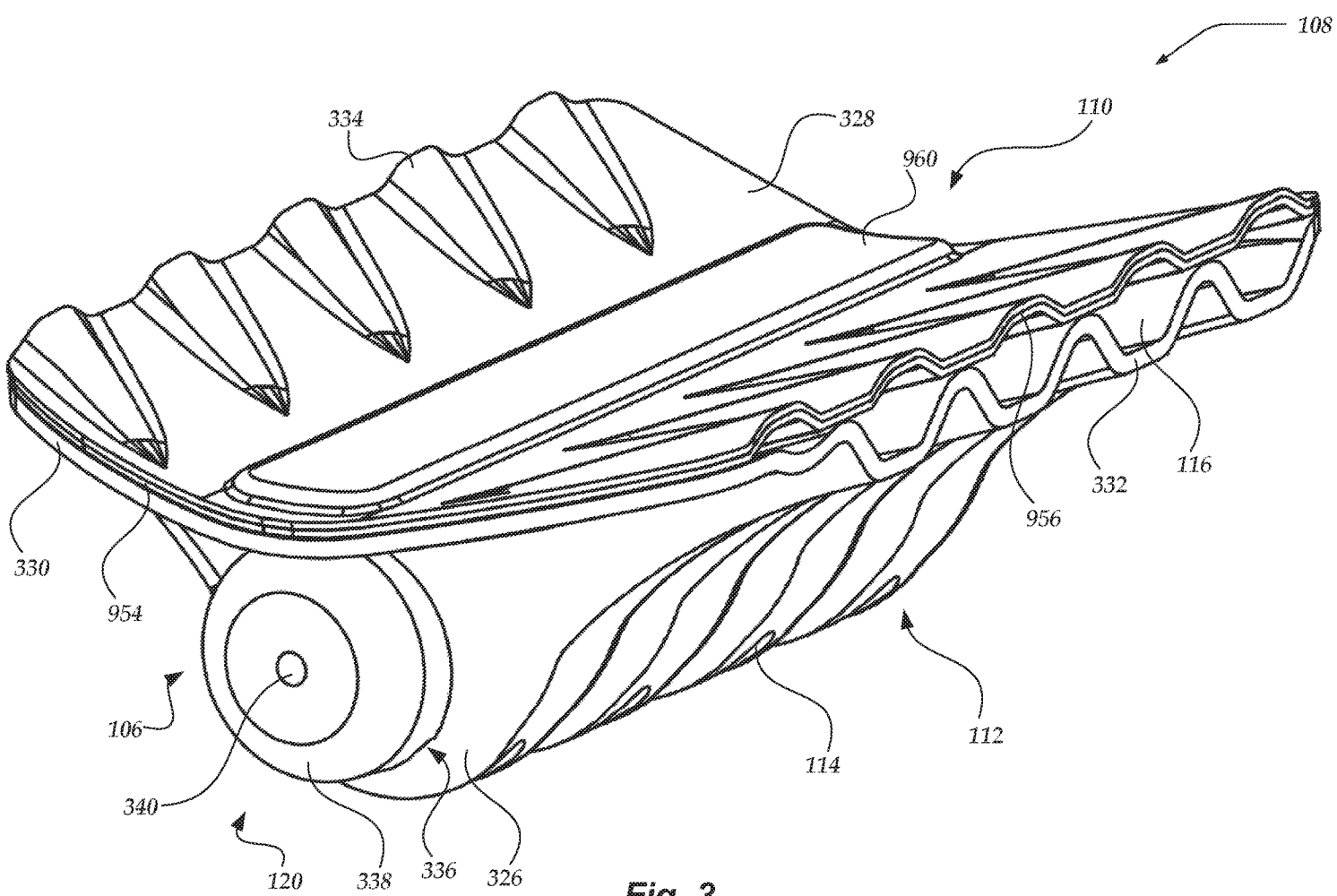
FIG. 3 shows an isometric view of the suppressor cover of FIG. 1 housing the suppressor as an element of the suppressor cover.

FIG. 3 shows an isometric view of suppressor cover 108 housing suppressor 106. In one or more of the various embodiments, suppressor 106 or at least a shell of suppressor 106 may be an element or component of suppressor cover 108. In some of the various embodiments, cover body 110 may include base 326 and top 328. In some embodiments, base 326 may have upper flange 330. In some embodiments, flange 330 may have one or more downward bends 332 (for example, U-shaped bends or others) that define one or more portions of exhaust ports 116. In some embodiments, top 328 may have one or more upward bends 334 (for example, U-shaped bends or others) that define one or more portions of exhaust ports 116. In some embodiments, one or more upward bends 334 may correspond to one or more downward bends 332 in upper flange 330 of base 326.

In one or more of the various embodiments, base 326 may have distal hole 336 that may be sized and dimensioned to match or exceed the outer size and dimensions of distal end portion 120 of suppressor 106. In some of the various embodiments, suppressor 106 may have end cap 338 that extends through distal hole 336. In some embodiments, end cap 338 may have projectile hole 340 to facilitate projectiles passing from barrel 104, through end cap 338, and toward a target.

Figure 4:
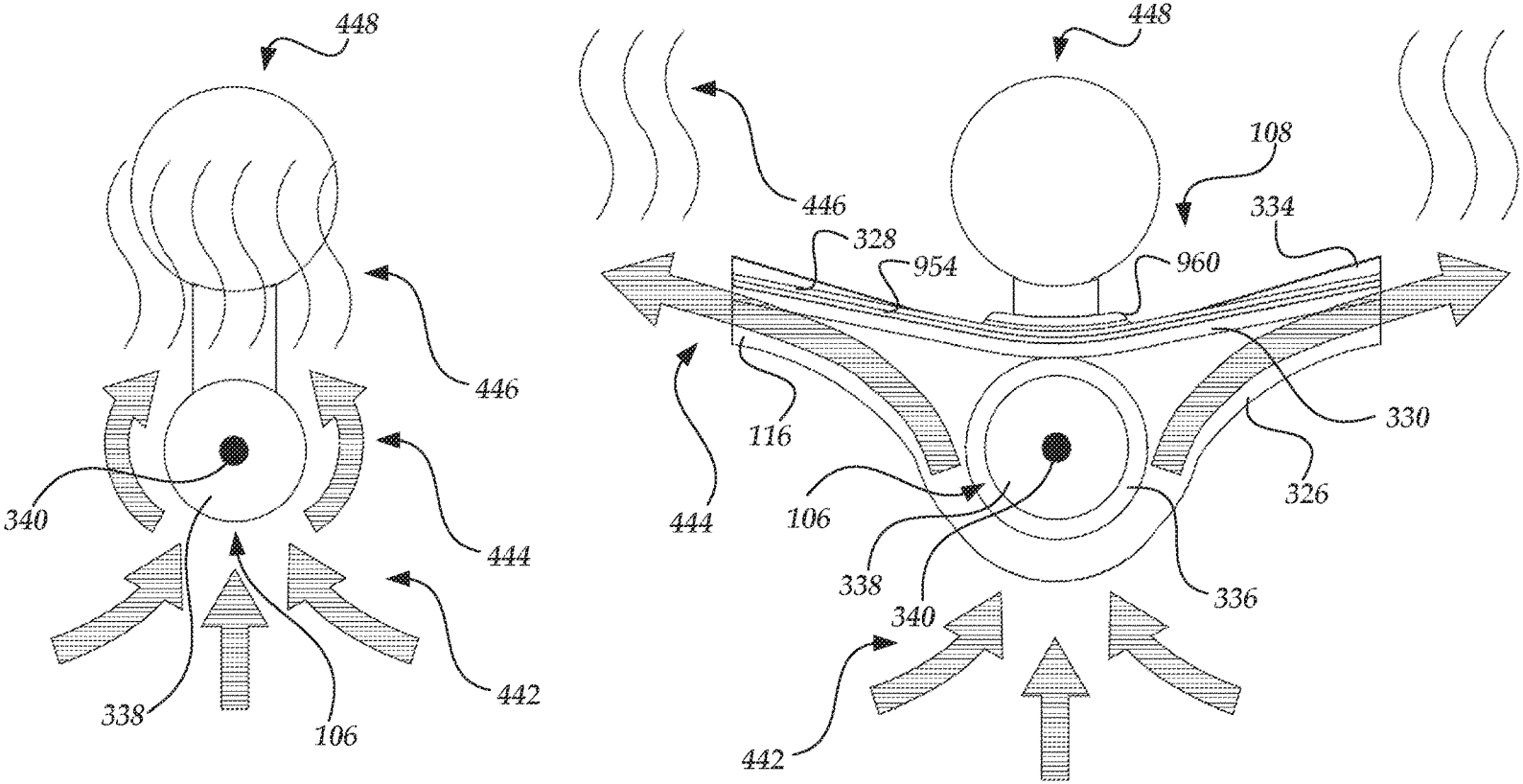
FIG. 4 illustrates a front view of the firearm of FIG. 1 during or immediately after rapidly firing the firearm, both without the suppressor cover and with the suppressor cover.

FIG. 4 illustrates a front view of firearm 102 of FIG. 1 during or immediately after rapidly firing firearm 102, both without suppressor cover 108 (left portion of FIG. 4) and with suppressor cover 108 (right portion of FIG. 4). As shown in FIG. 4, air 442 that approaches suppressor 106 from under suppressor 106 heats up to become rising hot air 444. As also shown in FIG. 4, hot air 444 may become sufficiently hot to generate heat haze 446. In one or more of the various embodiments, firearm 102 may have sights 448 that are laterally aligned with and vertically offset above suppressor 106. As shown at the left side of FIG. 4, without suppressor cover 108, heat haze 446 may reside in a shooter's line of sight through sight 448 to a target and may distort the shooter's ability to clearly see the target and to accurately aim at the target.

In contrast, as shown at the right side of FIG. 4, suppressor cover 108 may guide hot air 444 to left and right sides of suppressor cover 108 and may displace heat haze 446 to left and right positions that are outside of the shooter's line of sight, thereby facilitating the shooter clearly seeing the target and accurately aiming at the target. In one or more of the various embodiments, air 442 may approach suppressor 106 through one or more intake ports 114. In some of the various embodiments, hot air 444 may escape from suppressor cover 108 through one or more exhaust ports 116. In some embodiments, the intake of air 442 through one or more intake ports 114 (see intake ports 114 in FIG. 3) and the venting of propulsion gases or heated air 444 through one or more exhaust ports 116 may promote airflow around barrel 104 or suppressor 106 and may increase the rate of heat flow from suppressor 106 (at least in comparison to the typical suppressor covers or wraps that contain the propulsion gases or heated air 444), thereby facilitating reducing the likelihood of causing damage to barrel 104 or suppressor 106. In some embodiments, exhaust ports 116 may be laterally spaced apart from the lateral edges of suppressor 106 by a distance that is the same as or 0.1, 0.25, 0.5, 0.75, 1.25, 1.5, 1.75, 2, or more times the lateral width of suppressor 106, distal hole 336, or sights 448, thereby facilitating displacing heat haze 446 to left and right side positions that are outside of the shooter's line of sight.

In one or more of the various embodiments, top 328 may have a bottom surface that slopes upward from the longitudinal axis of top 328 out to the laterally outer edges of top 328, thereby facilitating displacing the rising hot air 444 to the laterally outer edges of top 328. In some of the various embodiments, top 328 may have an upper surface that slopes upward from the longitudinal axis of top 328 out to the laterally outer edges of top 328, thereby facilitating each portion of top 328 that is laterally aligned with sights 448 being disposed below sights 448 to avoid obstructing the shooter's line of sight, even with low sight mounts, rings, or others or with large sight diameters.

Figure 5:
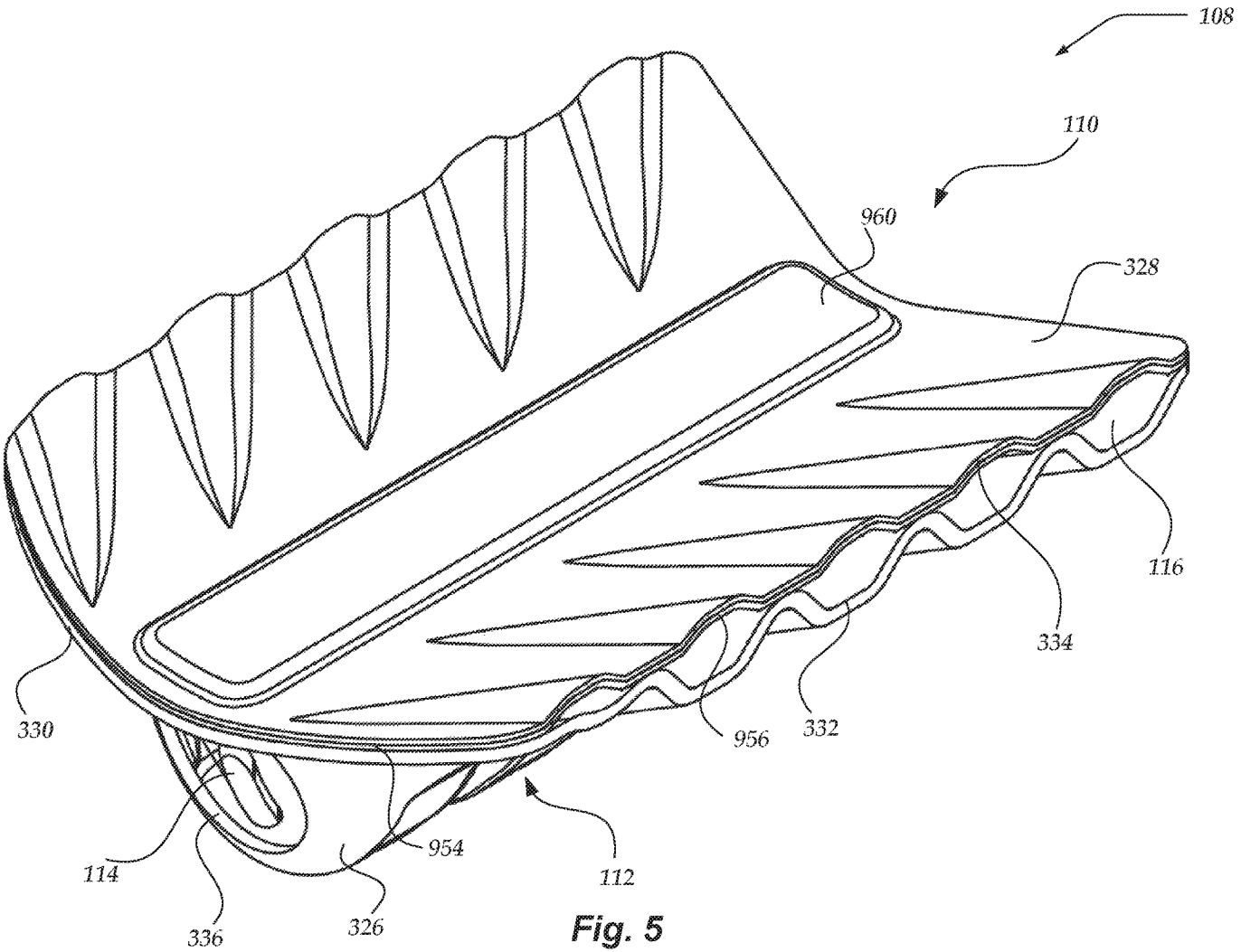
FIG. 5 shows an isometric view of the suppressor cover of FIG. 1.
Figure 6:
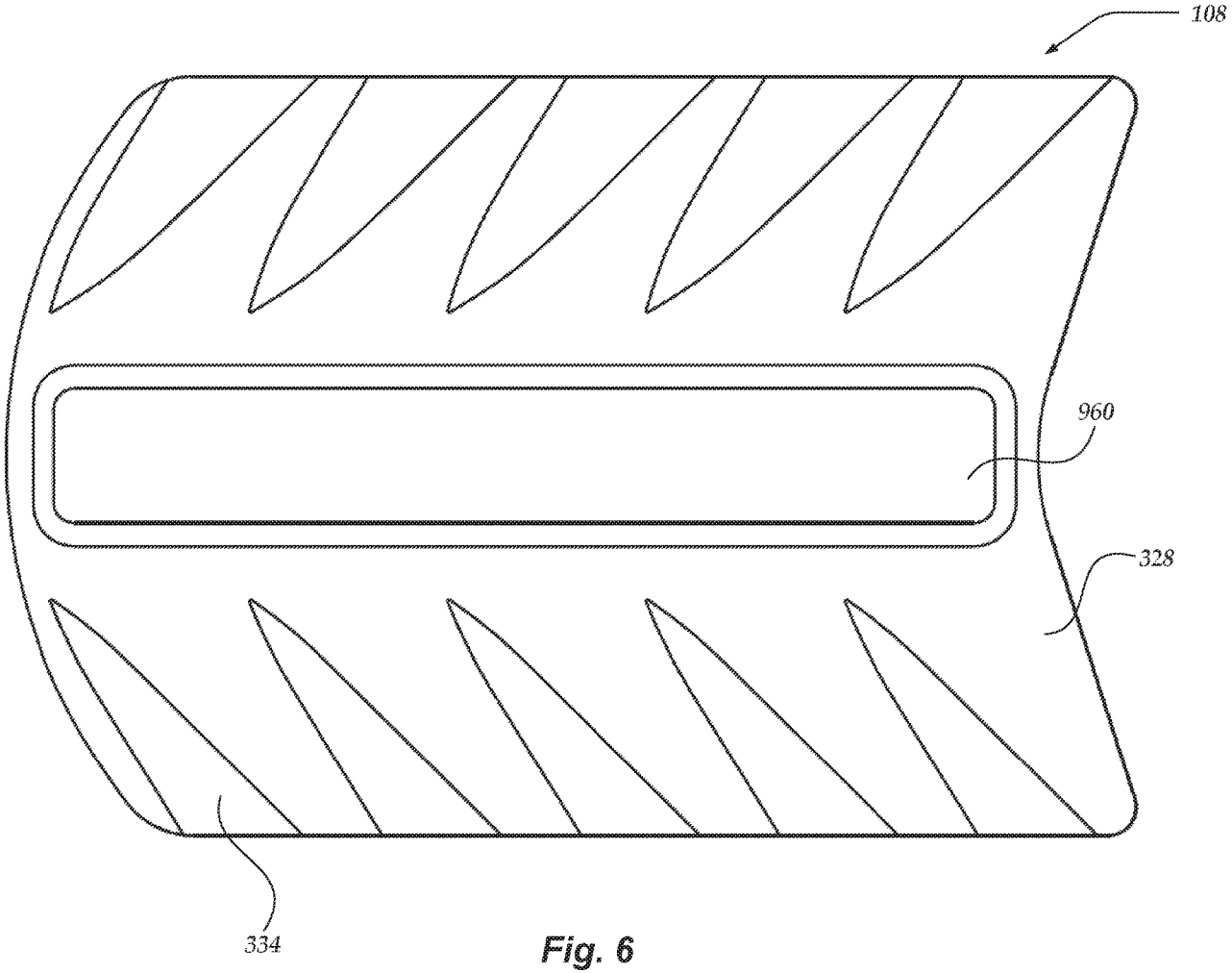
FIG. 6 illustrates a top view of the suppressor cover of FIG. 1.

FIG. 5 shows an isometric view of suppressor cover 108. In one or more of the various embodiments, one or more upward bends 334 may extend inward from one or more of the laterally outer edges of top 328 in a direction that is transverse to the longitudinal and lateral axes of top 328. FIG. 6 illustrates a top view of suppressor cover 108. In some of the various embodiments, the lateral vector of the inward extension from one or more of the laterally outer edges of top 328 may have a length of one sixth, fifth, fourth, third, or more of the lateral length of top 328. In some embodiments, the longitudinal vector of the inward extension may have a length of more than, less than, or equal to double the maximum outer diameter of the one or more of upward bends 334. In some embodiments, one or more upward bends 334 may have a length as measured parallel to the longitudinal axis of suppressor cover 108 that is larger closer to the longitudinal axis of suppressor cover 108 and that is smaller closer to one or more laterally outer edges of top 328, with a maximum length at one or more laterally outer edges of top 328.

Figure 7:
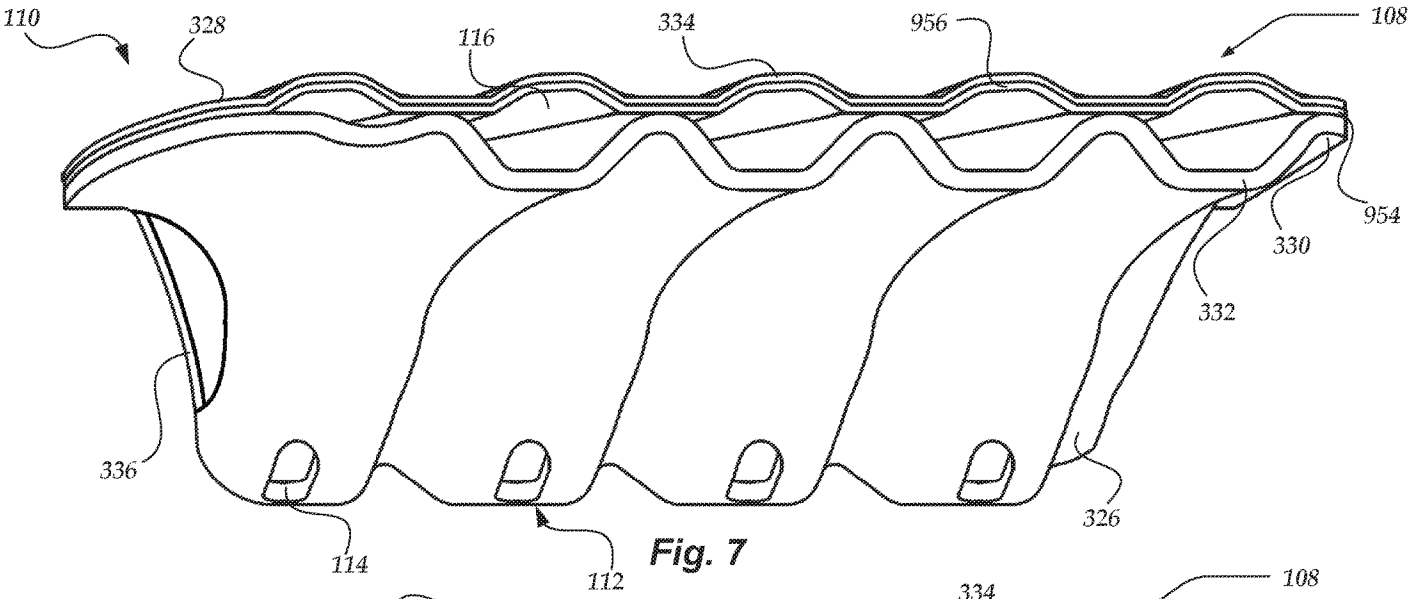
FIG. 7 shows a side view of the suppressor cover of FIG. 1.

FIG. 7 shows a side view of suppressor cover 108. In one or more of the various embodiments, one or more of the left or right sides of one or more segments 112 has one or more intake ports 114 disposed at a lower portion of base 326, such as below a longitudinal axis of suppressor 106, below a bottom surface of suppressor 106, below a center point of distal hole 336, below a bottom edge of distal hole 336, or others. In some of the various embodiments, one or more intake ports 114 may extend from the left side of one or more segments 112 to the right side of the one or more of segments 112.

Figure 8:
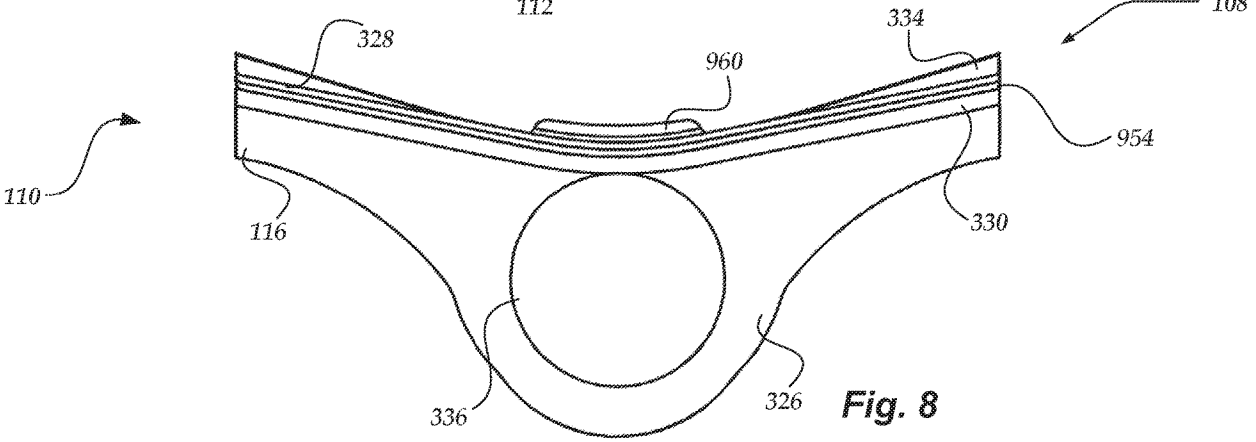
FIG. 8 illustrates a front elevational view of the suppressor cover of FIG. 1.

FIG. 8 illustrates a front elevational view of suppressor cover 108. In one or more of the various embodiments, distal hole 336 may be positioned in base 326 with an upper edge of distal hole 336 being where flange 330 begins to extend from the distal-most one of segments 112, thereby providing a low profile of the portion of suppressor cover 108 that is disposed above suppressor 106 to facilitate decreasing the amount of impedance to the shooter's line of sight.

Figure 9:
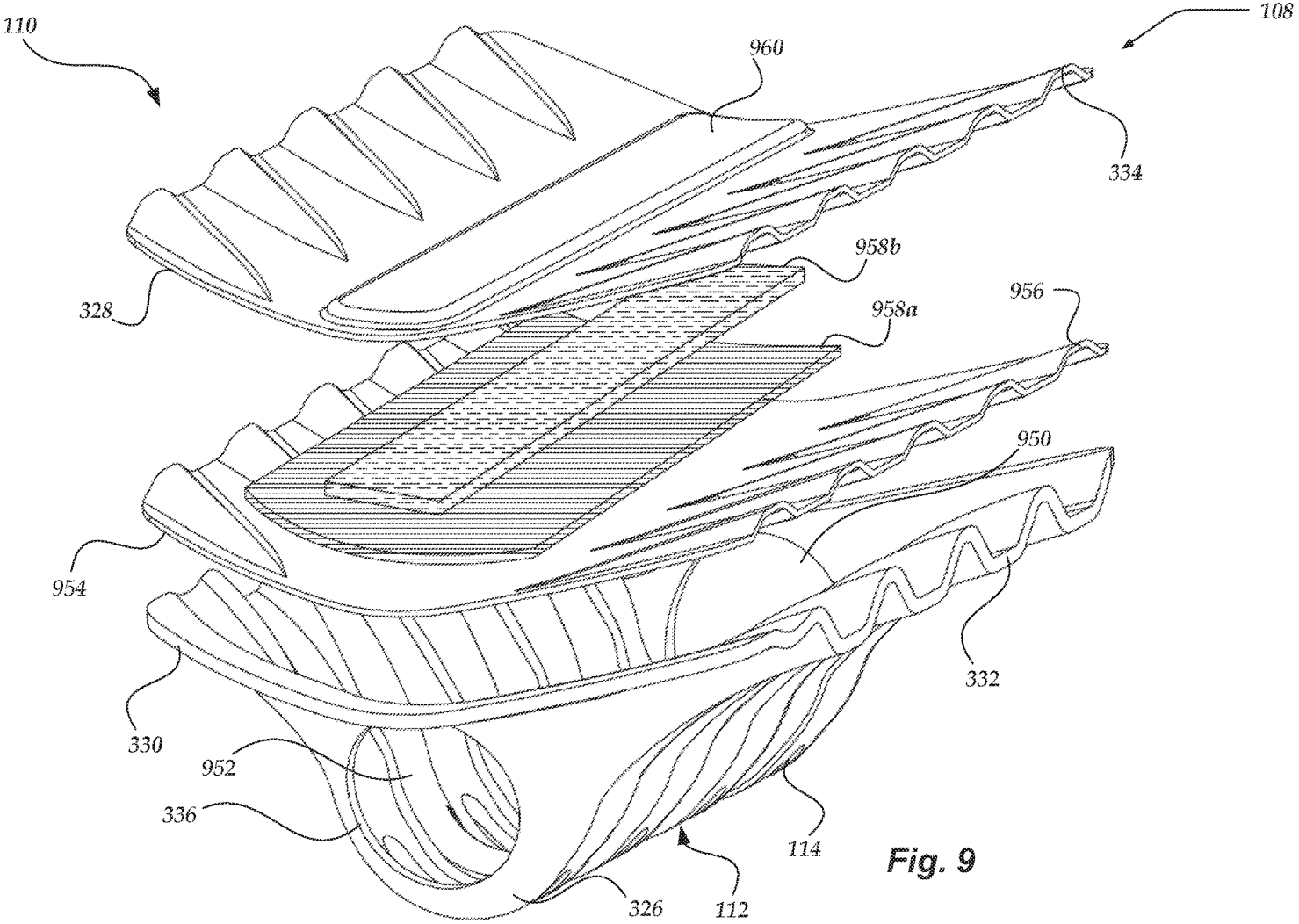
FIG. 9 shows an exploded isometric view of the suppressor cover of FIG. 1.

FIG. 9 shows an exploded isometric view of suppressor cover 108. In one or more of the various embodiments, base 326 may have proximal hole 950 that may be sized and dimensioned to match or exceed the outer shape and dimensions of barrel 104 or proximal end portion 120 of suppressor 106. In some of the various embodiments, proximal hole 950 may be positioned in base 326 with an upper edge of proximal hole 950 being where flange 330 begins to extend from the proximal-most one of segments 112, thereby providing a low profile of the portion of suppressor cover 108 that is disposed above suppressor 106 to facilitate decreasing the amount of impedance to the shooter's line of sight. In some embodiments, one or more of distal hole 336 or proximal hole 950 may extend through upper flange 330, thereby facilitate dropping barrel 104 or suppressor 106 into body 326, as opposed to sliding barrel 104 or suppressor 106 through distal hole 336 or proximal hole 950.

In one or more of the various embodiments, base 326 may have one or more ribs 952 that extend from the left edge of suppressor cover 108 to the right edge of suppressor cover 108. In some of the various embodiments, one or more ribs 952 may be positioned between intake ports 114 or exhaust ports 116 of adjacent segments 112. In some embodiments, longitudinally spaced apart ribs 952 may define an airflow channel disposed between the longitudinally spaced apart ribs 952, thereby facilitating guiding heated air 444 or propellant gases toward one or more exhaust ports 116 disposed between the longitudinally spaced apart ribs 952. In some embodiments, one or more ribs 952 and one or more airflow channels defined by the one or more of ribs 952 may have a lower portion that is distal to the upper portion such that one or more intake ports 114 may be disposed distal to one or more exhaust ports 116 that are disposed in the same airflow channel as the one or more of intake ports 114, thereby facilitating guiding heated air 444 or propellant gases in a direction that is transverse to the longitudinal and lateral axes of suppressor cover 108 to reduce the signature (for example, sound, flash, light, heat, or other signatures) of firearm 102 or to reduce the amount of the signature present in the shooter's line of sight.

In one or more of the various embodiments, suppressor cover 108 may include intermediate cap 954 disposed between base 326 and top 328, thereby facilitating decreasing thermal conduction to or through top 328. In some of the various embodiments, intermediate cap 954 may have a longitudinal length and a lateral length that corresponds to the longitudinal length and the lateral length of top 328. In some embodiments, intermediate cap 954 may have one or more upward bends 956 that correspond to one or more upward bends 334 in top 328. In some embodiments, one or more upward bends 956 in intermediate cap 954 may have an upper surface that is sized and dimensioned to correspond to a lower surface of one or more corresponding upward bends 334 in top 328.

In one or more of the various embodiments, one or more insulation layers 958 may be disposed above top 328 or below top 328, such as between intermediate cap 954 and top 328. In some of the various embodiments, suppressor cover 108 may include one or more wide insulation layers **958*a* or one or more narrow insulation layers 958*b*. In some embodiments, one or more wide insulation layers 958*a* or narrow insulation layers 958*b* may have longitudinal lengths that match the longitudinal length of one or more of intermediate cap 954 or top 328. In some embodiments, one or more insulation layers 958 may include one or more thermal insulation materials, such as aerogel (for example, silica, carbon, metal oxide, organic polymer, chalcogen, graphene, or other aerogels), fiberglass, mineral wool, cellulose, polyurethane foam, polystyrene, or others. In some embodiments, one or more insulation layers 958 may include one or more injected foams, injected liquids, self-expanding foams, felts, fibers, staples, or others. In some embodiments, one or more insulation layers 958 may include the same one or more materials of base 326** formed in a lattice or other structure.

In one or more of the various embodiments, one or more wide insulation layers **958*a* may have a lateral length that extends from the central-most portions of upward bends 334 or upward bends 956 in the left side of suppressor cover 108 to the central-most portions of upward bends 334 or upward bends 956 in the right side of suppressor cover 108. In some of the various embodiments, one or more wide insulation layers 958***a* may laterally extend between one or more portions of upward bends 334 or upward bends 956. In some embodiments, one or more wide insulation layers 958*a* may overlap one or more portions of one or more upward bends 334 or upward bends 956.

In one or more of the various embodiments, one or more narrow insulation layers 958*b* may have a lateral length that corresponds to the lateral length or diameter of suppressor 106, sights 448, or others. In some of the various embodiments, disposing one or more narrow insulation layers 958*b* above and laterally central to one or more wide insulation layers 958*a* may decrease thermal conduction to and through the laterally central portion of top 328, thereby facilitating reducing the likelihood of heat haze 446 residing in the shooter's line of sight. In some embodiments, one or more of top 328 or intermediate cap 954 may have one or more recesses that accommodate one or more insulation layers 958. In some embodiments, one or more of top 328 or intermediate cap 954 may have one or more bulges 960 in the face that is opposite from the face with the one or more recesses.

Figure 10:
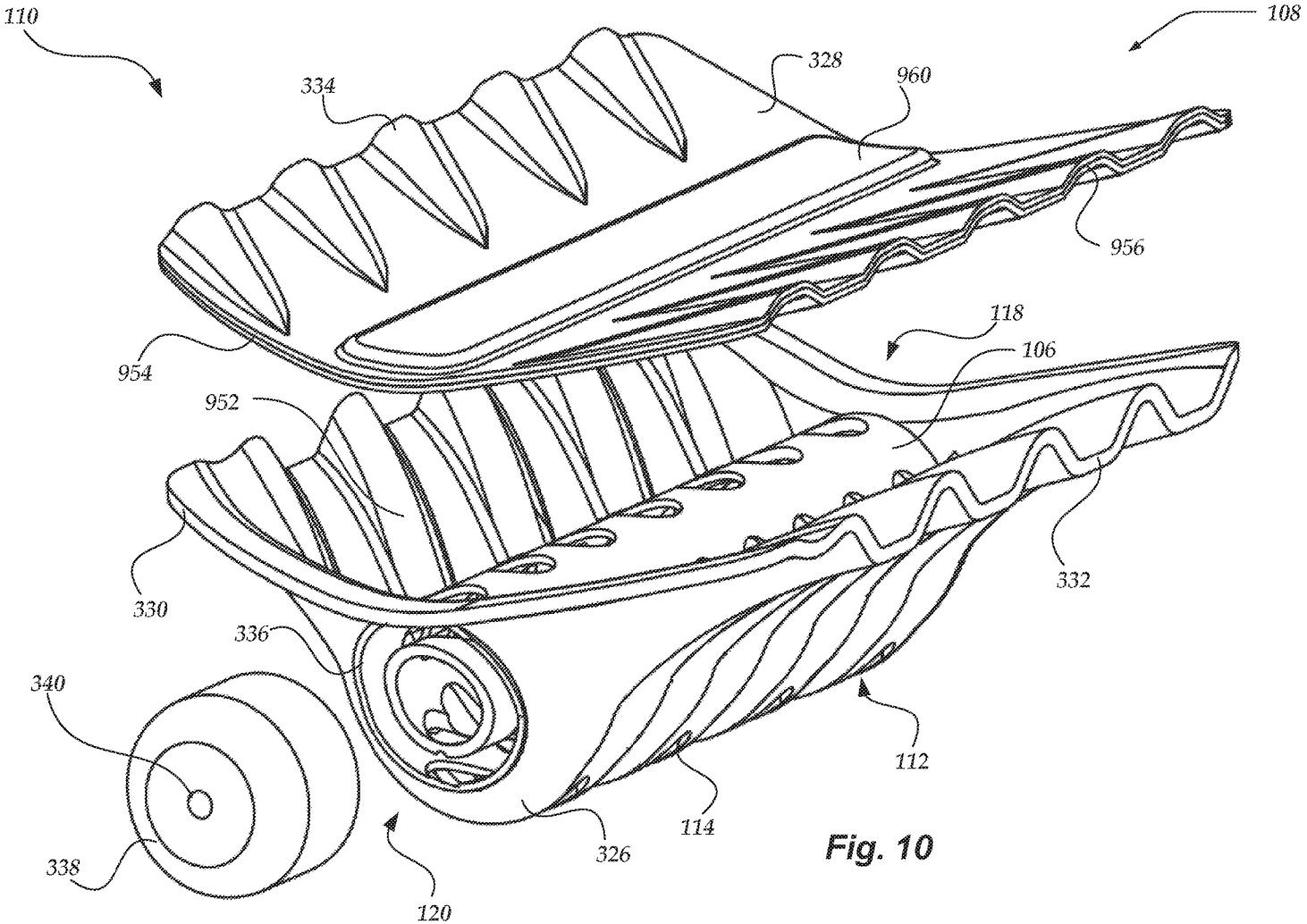
FIG. 10 illustrates a partially-exploded isometric view of the suppressor cover of FIG. 1 housing the suppressor as an element of the suppressor cover.
Figure 11:
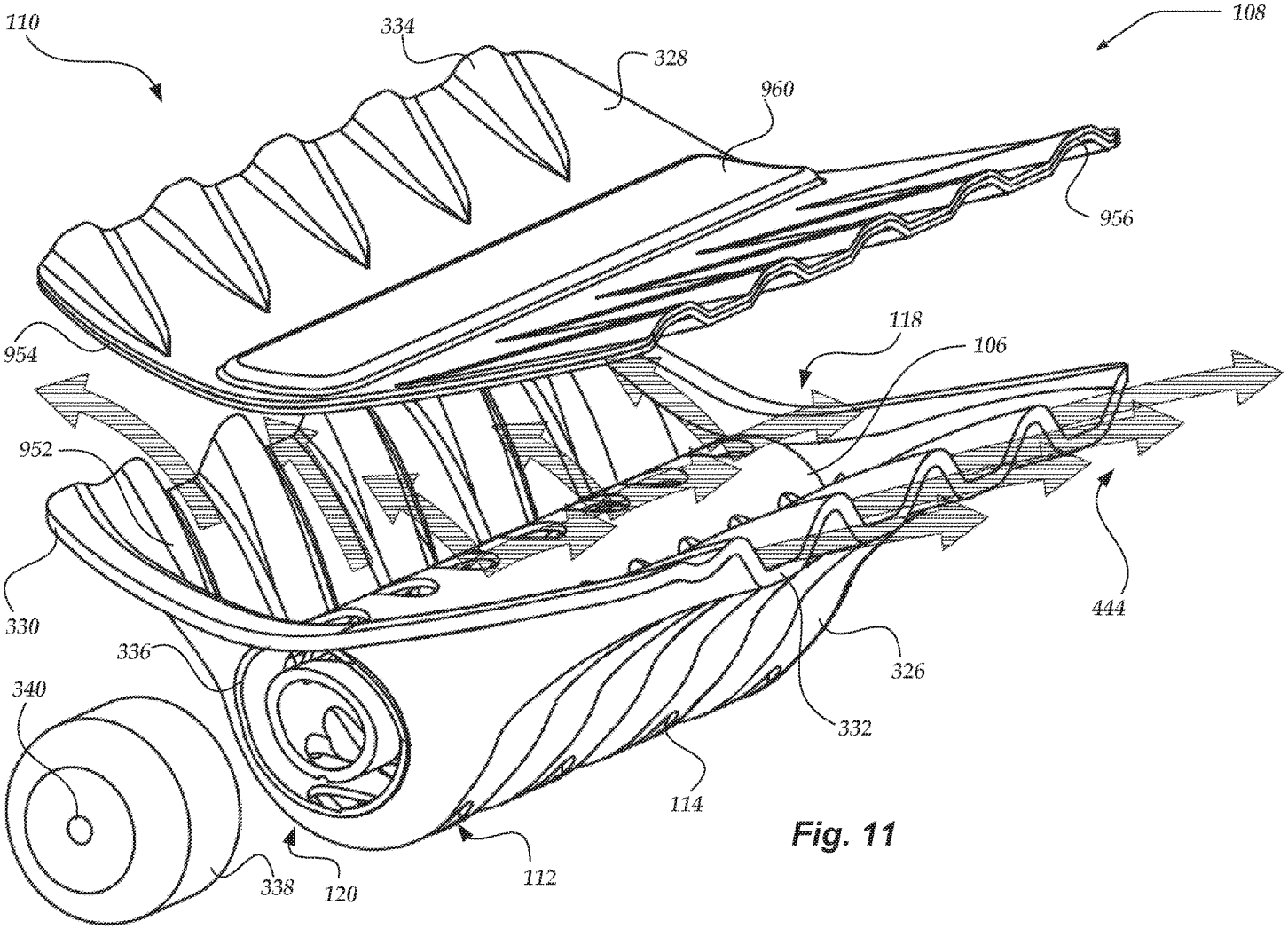
FIG. 11 shows a partially-exploded isometric view of the suppressor cover of FIG. 1 housing the suppressor, showing exhaust paths of heated air.

FIG. 10 illustrates a partially-exploded isometric view of suppressor cover 108 housing suppressor 106 as an element of suppressor cover 108. FIG. 11 shows a partially-exploded isometric view of suppressor cover 108 housing suppressor 106, with exhaust paths of propellant gas or heated air 444.

In one or more of the various embodiments, each segment 112 may be defined by a portion of base 326 and a corresponding portion of top 328. In some of the various embodiments, base portions of multiple segments 112 may be integral or fixedly coupled to each other. In some embodiments, one or more base portions of one or more segments 112 may be separably coupled to one or more other base portions of one or more other segments 112. In some embodiments, top portions of multiple segments 112 may be integral or fixedly coupled to each other. In some embodiments, one or more top portions of one or more segments 112 may be separably coupled to one or more other top portions of one or more other segments 112. In some embodiments, two or more segments 112 may be fixedly coupled to each other with adhesive, solder, brazing, welding, or others. In some embodiments, two or more segments 112 may separably couple to each other with threads, fasteners (for example, bolts, clips, clamps, or others), Snap-fit, interference fit, or others.

In one or more of the various embodiments, two or more of base 326, top 328, or intermediate cap 954 may be integrally, fixedly, or separably coupled to each other. In some of the various embodiments, two or more of base 326, top 328, or intermediate cap 954 may be fixedly coupled to each other with adhesive, solder, brazing, welding, or others. In some embodiments, two or more of base 326, top 328, or intermediate cap 954 may be separably coupled to each other with fasteners (for example, bolts, clips, clamps, or others), Snap-fit, interference fit, or others.

The terms "front," "rear," "top," "bottom," "frontward," "rearward," "proximal," "distal," and variants thereof are used consistently with respect to all elements and are defined relative to proximal hole 950 of suppressor cover 108. The terms "longitude," "lateral," "height," and variants thereof are also used consistently with respect to all elements and are defined relative to the longitudinal axis of suppressor cover 108. The longitudinal axis of suppressor cover 108 extends along the lateral center of suppressor cover 108 from the proximal end portion of suppressor cover 108 to the distal end portion of suppressor cover 108. The lateral axis of suppressor cover 108 is perpendicular to the longitudinal axis of suppressor cover 108 and extends along the longitudinal center of suppressor cover 108. The height of suppressor cover 108 is transverse to the longitudinal axis and the lateral axis of suppressor cover 108. The terms "left," "right," and variants thereof are used consistently with respect to all elements and are defined relative to the longitudinal axis of suppressor cover 108 as viewed from the perspective of the shooter of firearm 102, such that, in FIGS. 1 and 2, the left side of suppressor cover 108 is visible.

The foregoing examples should not be construed as limiting or exhaustive, yet rather, illustrative use cases to show implementations of at least one of the various embodiments of the invention. Accordingly, many changes can be made without departing from the spirit and scope of the invention. For example, although the figures show round proximal holes 950, distal holes 336, and lower portions of base 326, various elements or features such as proximal holes 950, distal holes 336, and lower portions of base 326 may have different shapes or dimensions such as polygonal (for example, hexagonal, octagonal, or others) or others to facilitate covering barrels 104 of different shapes or dimensions, covering suppressors 106 of different shapes or dimensions, or handling different calibers or firearm types. As another example, one or more ribs 952, airflow channels, downward bends 332, upward bends 334, intake ports 114, exhaust ports 116, or other internal elements or features may have different shapes, dimensions, orientations, positions, or other characteristics to accommodate different airflow rates, diversion patterns or directions, or others based, for example, on the type or characteristics of suppressor 106. As a further example, suppressor cover 108 may be separable from each component of suppressor 106, or, instead, at least a shell of suppressor 106 may be integral or fixedly coupled to body 110 of suppressor cover 108. As an additional example, suppressor cover 108 may include one or more fans and one or more power sources (for example, one or more solar panels, batteries, or others) to power the one or more fans, thereby facilitating increasing airflow in body 110. As another example, one or more modular attachment mechanisms (for example, one or more Picatinny rails, KeMod interface systems, M-LOK interface systems, or others) may be integral, fixedly coupled, or separably coupled to one or more exterior surfaces of body 110 to facilitate coupling accessories to suppressor cover 108. Thus, the scope of the invention is not limited by the disclosure of the examples. Instead, the invention should be determined entirely by reference to the claims that follow.

The embodiments of the invention in which an exclusive property or privilege is claimed are defined as follows:

1. A suppressor cover for firearm suppressors, comprising:

a cover body that is sized and dimensioned to house a suppressor of a firearm having one or more sights, the body having a longitudinal axis and a lateral axis, the body having an upper portion and a lower portion, the body being coupleable to the firearm below the one or more sights, the body having one or more intake ports that are disposed in the lower portion of the body, and the body having one or more exhaust ports that are disposed in the upper portion of the body and that are laterally spaced apart from the one or more sights when the body is coupled to the firearm, the one or more exhaust ports being fluidly coupled to the one or more intake ports through an interior of the cover body, the suppressor having left and right laterally outermost edges, an entirety of the one or more exhaust ports being disposed laterally outside the left and right laterally outermost edges of the suppressor, the one or more exhaust ports being disposed entirely above a centerline of the body as measured in a vertical direction.

2. The suppressor cover of claim 1, wherein the upper portion of the body has an outwardly extending flange, the flange having one or more downward bends that at least partially define at least one of the one or more exhaust ports.

3. The suppressor cover of claim 1, wherein the upper portion of the body has left and right laterally outer edges and one or more upward bends in one or more of the left and right laterally outer edges, the one or more upward bends at least partially defining at least one of the one or more exhaust ports.

4. The suppressor cover of claim 1, wherein the upper portion of the body has left and right laterally outer edges and one or more upward bends in one or more of the left and right laterally outer edges, the one or more upward bends at least partially defining at least one of the one or more exhaust ports and extending inward from the one or more of the left and right laterally outer edges.

5. The suppressor cover of claim 1, wherein the upper portion of the body has left and right laterally outer edges and one or more upward bends in one or more of the left and right laterally outer edges, the one or more upward bends at least partially defining at least one of the one or more exhaust ports and extending inward from the one or more of the left and right laterally outer edges in a direction that is transverse to the longitudinal and lateral axes of the body.

6. The suppressor cover of claim 1, wherein the body has a proximal end portion and a distal end portion, the longitudinal axis of the body being laterally central to the body and extending from the proximal end portion to the distal end portion, and the body has a top surface that has left and right laterally outer edges that extend from the proximal end portion to the distal end portion, the top surface of the body being lower along the longitudinal axis of the body than at the left and right laterally outer edges of the top surface.

7. The suppressor cover of claim 1, wherein the body has one or more ribs that project inward and that extend from the lower portion of the body to the upper portion of the body.

8. The suppressor cover of claim 1, wherein the body has two or more ribs that project inward and that extend from the lower portion of the body to the upper portion of the body to define one or more airflow channels between the two or more ribs, each of the one or more airflow channels fluidly coupling at least one of the one or more intake ports to at least one of the one or more exhaust ports.

9. The suppressor cover of claim 1, wherein the body has two or more ribs that project inward and that extend from the lower portion of the body to the upper portion of the body to define one or more airflow channels between the two or more ribs, the body having a proximal end portion and a distal end portion with the longitudinal axis of the body extending from the proximal end portion to the distal end portion, each of the one or more airflow channels being more proximal in the upper portion of the body than in the lower portion of the body.

10. The suppressor cover of claim 1, wherein the one or more sights have left and right laterally outer edges and a lateral length that extends from the left laterally outer edge to the right laterally outer edge, and the one or more exhaust ports are laterally spaced apart from the lateral outer edges of the one or more sights by a distance that is at least 10% of the lateral length of the one or more sights.

11. The suppressor cover of claim 1, wherein the body comprises:

a base having an upper portion and a lower portion with the one or more intake ports disposed in the lower portion of the base;

a top coupled to the upper portion of the base; and an intermediate cap disposed between the base and the top.

12. The suppressor cover of claim 1, further comprising one or more insulation layers coupled to the upper portion of the body.

13. The suppressor cover of claim 1, further comprising one or more insulation layers coupled to the upper portion of the body, wherein the upper portion of the body has a recess that is sized and dimensioned to receive at least one of the one or more insulation layers.

14. The suppressor cover of claim 1, wherein the body has a proximal end portion and a distal end portion, each of the proximal and distal end portions has a hole that is sized and dimensioned to receive the suppressor.

15. The suppressor cover of claim 1, wherein, when the body houses the suppressor, the one or more intake ports are disposed below the suppressor, and, when the body houses the suppressor, the one or more exhaust ports are disposed above the suppressor.

16. The suppressor cover of claim 1, wherein the upper portion of the body has an outwardly extending flange that defines left and right laterally outer edges of the upper portion of the body that define the one or more exhaust ports.

17. A suppressor cover for firearm suppressors, comprising:

a cover body that is sized and dimensioned to house a suppressor of a firearm having one or more sights, the body having a longitudinal axis and a lateral axis, the body having an upper portion and a lower portion, the body being coupleable to the firearm below the one or more sights, the body having one or more intake ports that are disposed in the lower portion of the body, and the body having one or more exhaust ports that are disposed in the upper portion of the body and that are laterally spaced apart from the one or more sights when the body is coupled to the firearm, the one or more exhaust ports being fluidly coupled to the one or more intake ports through an interior of the cover body, wherein the upper portion of the body has left and right laterally outer edges and one or more upward bends in one or more of the left and right laterally outer edges, the one or more upward bends at least partially defining at least one of the one or more exhaust ports and extending inward from the one or more of the left and right laterally outer edges in a direction that is transverse to the longitudinal and lateral axes of the body.

18. A suppressor cover for firearm suppressors, comprising:

a cover body that is sized and dimensioned to house a suppressor of a firearm having one or more sights, the body having a longitudinal axis and a lateral axis, the body having an upper portion and a lower portion, the body being coupleable to the firearm below the one or more sights, the body having one or more intake ports that are disposed in the lower portion of the body, and the body having one or more exhaust ports that are disposed in the upper portion of the body and that are laterally spaced apart from the one or more sights when the body is coupled to the firearm, the one or more exhaust ports being fluidly coupled to the one or more intake ports through an interior of the cover body, wherein the body has a proximal end portion and a distal end portion, the longitudinal axis of the body being laterally central to the body and extending from the proximal end portion to the distal end portion, and the body has a top surface that has left and right laterally outer edges that extend from the proximal end portion to the distal end portion, the top surface of the body being lower along the longitudinal axis of the body than at the left and right laterally outer edges.

19. A suppressor cover for firearm suppressors, comprising:

a cover body that is sized and dimensioned to house a suppressor of a firearm having one or more sights, the body having a longitudinal axis and a lateral axis, the body having an upper portion and a lower portion, the body being coupleable to the firearm below the one or more sights, the body having one or more intake ports that are disposed in the lower portion of the body, and the body having one or more exhaust ports that are disposed in the upper portion of the body and that are laterally spaced apart from the one or more sights when the body is coupled to the firearm, the one or more exhaust ports being fluidly coupled to the one or more intake ports through an interior of the cover body, wherein the body has two or more ribs that project inward and that extend from the lower portion of the body to the upper portion of the body to define one or more airflow channels between the two or more ribs, each of the one or more airflow channels fluidly coupling at least one of the one or more intake ports to at least one of the one or more exhaust ports.

20. A suppressor cover for firearm suppressors, comprising:

a cover body that is sized and dimensioned to house a suppressor of a firearm having one or more sights, the body having a longitudinal axis and a lateral axis, the body having an upper portion and a lower portion, the body being coupleable to the firearm below the one or more sights, the body having one or more intake ports that are disposed in the lower portion of the body, and the body having one or more exhaust ports that are disposed in the upper portion of the body and that are laterally spaced apart from the one or more sights when the body is coupled to the firearm, the one or more exhaust ports being fluidly coupled to the one or more intake ports through an interior of the cover body, wherein the body comprises:

a base having an upper portion and a lower portion with the one or more intake ports disposed in the lower portion of the base;

a top coupled to the upper portion of the base; and an intermediate cap disposed between the base and the top.

* * * * *